US006696405B2

(12) United States Patent
Mooney

(10) Patent No.: US 6,696,405 B2
(45) Date of Patent: Feb. 24, 2004

(54) CREASE RECOVERY OF FABRICS

(75) Inventor: William Mooney, Wirral (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/319,039

(22) Filed: Dec. 13, 2002

(65) Prior Publication Data

US 2003/0125228 A1 Jul. 3, 2003

Related U.S. Application Data

(62) Division of application No. 09/709,910, filed on Nov. 9, 2000, now abandoned.

(30) Foreign Application Priority Data

Nov. 9, 1999 (GB) ..... 9926560

(51) Int. Cl.[7] ..... C11D 3/18
(52) U.S. Cl. ..... 510/461; 510/516
(58) Field of Search ..... 510/461, 516, 510/513

(56) References Cited

U.S. PATENT DOCUMENTS 4,913,828 A * 4/1990 Caswell et al. ..... 252/88
5,300,238 A * 4/1994 Lin et al. ..... 252/8.6

FOREIGN PATENT DOCUMENTS

EP 278846 A1 * 8/1988
EP 0371534 A2 6/1990
EP 0371535 A2 6/1990
GB 1601360 10/1981
JP 7-42073 * 2/1995
WO 96/15310 5/1996

OTHER PUBLICATIONS

WPI Abstract Acc. No. 1998–329006 (JP 10121373 A) (Matsuura et al.).
WPI Abstract Acc. No. 1995–119205 (JP 7042073 A) (Fuji et al.).
WPI Abstract Acc. No. 1995–041817 (JP 6322670 A) (Ensuiko et al.).
WPI Abstract Acc. No. 1995–078553/199511 (JP A 7003637).
WPI Abstract Acc. No. 1992–109202/199214 (JP A 4050234).
WPI Abstract Acc. No. 1991–012417 (JP 2286708 A) (Nippon Oil et al.).
WPI Abstract Acc. No. 1990–086474/199012 (JP A 2038461).
WPI Abstract Acc. No. 1988–349737/198849 (JP A 63260998).

* cited by examiner

*Primary Examiner*—John Hardee
(74) *Attorney, Agent, or Firm*—Alan A. Bornstein

(57) ABSTRACT

The crease recovery of fabrics can be improved using $C_{20}$–$C_{40}$ saturated or unsaturated aliphatic hydrocarbons which have melting points below 0° C., such as squalane. The hydrocarbons may be included in garment care products adapted for use in a tumble dryer, such as flexible sheets, in sprayable formulations or in fabric care compositions, such as fabric conditioning compositions which comprise a fabric softening agent. Fabrics may be treated with the hydrocarbons as part of a domestic laundering process.

14 Claims, 1 Drawing Sheet

CREASE RECOVERY OF FABRICS

This is a divisional of Ser. No. 09/709,910 filed Sep, 9, 2000 abandoned

This invention relates to the use of certain hydrocarbon compounds to improve the crease recovery properties of a fabric, to garment care products adapted for use in a tumble dryer and fabric care compositions which comprise the hydrocarbon and to a method of treating a fabric to improve its crease recovery properties.

The creasing of fabrics is an almost inevitable consequence of cleaning fabrics, such as in a domestic laundering process. Creasing can be a particular problem for fabrics which contain cellulosic fibres such as cotton because the creasing is often difficult to remove. Generally, the creases which are developed in a fabric during laundering are removed by ironing. However, because ironing is generally seen as time-consuming and an unenjoyable activity, there is an increasing trend for fabrics to be designed such that the need for ironing is reduced or that the fabric is easier to iron. The term "crease recovery properties", as used herein, covers the need for ironing and/or ease of ironing. Thus, an improvement in crease recovery properties means a reduction in the need for ironing and/or increased ease of ironing.

Compositions for reducing the wrinkling of fabric are described in WO 96/15310. The compositions contain a silicone and a film-forming polymer and it appears that the lubricating effect of the silicone is responsible for the anti-wrinkle properties of the compositions.

Industrial treatments of fabrics to reduce their tendency to crease are also known. JP-A-04-50234 describes a textile treatment in which the crease resistance of a plain weave cotton fabric is increased by applying a resin to the fabric. However, in order to achieve the crease resistance, this document teaches that the resin is applied at a relatively high amount of 10% by weight on weight of fabric and it is likely that this relatively high level of resin will affect other physical properties of the fabric.

Squalane, a saturated $C_{30}$ aliphatic hydrocarbon which can be obtained from natural sources, is widely used in cosmetic formulations for skin care, for moisture retention and wrinkle reduction. Emulsions containing squalane for applying a finish to fabrics are disclosed in JP-A-02-286708 and JP-A-02-38461. Dry cleaning using squalane-containing solvents is taught in JP-A-63-260998. Softening agents for finishing fabrics and textiles which contain squalane are mentioned in JP-A-07-42073 and JP-A-07-03637.

It is an object of the present invention to improve the crease recovery of fabrics.

It is a further object of the invention to provide a method of improving the crease resistance properties of a fabric which can be carried out as part of a laundering process.

The present invention is based on the finding that certain hydrocarbons can improve the crease recovery properties of a fabric.

According to the invention, therefore, there is provided the use of a $C_{20}$–$C_{40}$ saturated or unsaturated aliphatic hydrocarbon, which has a melting point below 0° C., to improve the crease recovery properties of a fabric.

Also provided by the invention is a garment care product adapted for use in a tumble dryer comprising a $C_{20}$–$C_{40}$ saturated or unsaturated aliphatic hydrocarbon, which has a melting point below 0° C., for use in a spraying device.

A further aspect of the invention is a fabric care composition comprising a $C_{20}$–$C_{40}$ saturated or unsaturated aliphatic hydrocarbon which has a melting point below 0° C.

and a textile compatible carrier, wherein the carrier facilitates contact between the hydrocarbon and the fabric. A method of producing the fabric care composition, which is provided in another aspect of the invention, comprises forming an emulsion comprising the hydrocarbon and the textile compatible carrier.

The products and compositions of the invention preferably comprise a perfume.

In yet another aspect, the invention provides a method of treating a fabric in order to improve its crease recovery properties which method comprises applying to the fabric a $C_{20}$–$C_{40}$ saturated or unsaturated aliphatic hydrocarbon, which has a melting point below 0° C.

The hydrocarbon which is used in the present invention has a melting point below 0° C., preferably below −10° C., more preferably below −20° C. This preference for low melting points primarily derives from the need for the hydrocarbon to be a liquid not only at the temperature at which it is applied to the fabric but also at all temperatures to which the fabric treated with the hydrocarbon is normally likely to be exposed. If the hydrocarbon solidifies, this can be undesirable because its physical properties and, in turn, the physical properties of the fabric, may change.

Preferably, the hydrocarbon comprises a straight chain backbone, such as a $C_{20}$ to $C_{30}$ chain for example, substituted with two or more $C_1$–$C_3$ alkyl groups. When the alkyl group is a $C_3$ group, it may be branched. Substitution on the straight chain backbone tends to reduce the melting point of the hydrocarbon relative to compounds not so substituted.

The straight chain backbone of the hydrocarbon is preferably substituted with two or more methyl groups, such as four to eight methyl groups (eg, six methyl groups), for example.

Suitable hydrocarbons include squalane and derivatives of squalane preferably saturated derivatives. Examples are derivatives of squalane in which the compounds are mono- or poly-substituted with $C_1$–$C_3$ alkyl groups or a homologue of any of these compounds (ie, a derivative of said compounds having one or more additional methylene —$CH_2$— groups in the molecule or one or more fewer methylene groups in the molecule). Preferably, the hydrocarbon is squalane which is colourless, substantially odourless and has been used in cosmetic formulations with claims for skin care benefits. The squalane can be synthetic or obtained from natural sources (eg, animal and/or vegetable sources).

Preferably, the hydrocarbons are saturated. Where the hydrocarbons are unsaturated, they preferably contain one or two, more preferably one, unsaturated carbon—carbon double bonds.

The hydrocarbon used in the present invention may be a single hydrocarbon or a mixture of hydrocarbons. The hydrocarbon or hydrocarbons may be formulated with other additives. Suitable additives in formulations containing the hydrocarbon include materials which impart benefits to a fabric or those which improve the acceptability of the hydrocarbon to the user of the formulation, such as one or more perfume agents.

The hydrocarbon is conveniently delivered to the fabric as part of a laundering process. The laundering process may be carried out on a large scale or a small scale (eg, domestically). However, the hydrocarbon may also be applied to the fabric in a larger scale, industrial treatment process.

When the hydrocarbon is applied to the fabric during a laundering process, such as a domestic laundering process, it is preferably delivered after the fabric has been treated with a main wash detergent composition. Thus, the hydrocarbon may be applied to the fabric during the rinse cycle of an automatic washing machine. Alternatively, the hydrocarbon may be applied to the fabric after rinsing but before drying of the fabric, during drying (in a tumble dryer, for example) or before or during ironing.

In the context of the present invention the term "textile compatible carrier" is a component which can assist in the interaction of the first component with the fabric. The carrier can also provide benefits in addition to those provided by the first component eg softening, cleaning etc. The carrier may be water or a fabric softener or conditioning compound or other suitable fabric treatment agent.

Therefore, the fabric care composition of the invention may be a rinse composition such as a fabric conditioning composition or a rinse adjunct. The rinse adjunct and the fabric conditioning composition may contain conventional additives, such as perfume agents, for example. The fabric conditioning composition may contain a fabric softening agent such as a quaternary ammonium compound of known types, for instance. The fabric care compositions of the invention are conveniently adapted for use in a domestic laundering process and are preferably packaged and labelled as such.

The term "fabric softening compound", as used herein, covers compounds having fabric softening and/or conditioning properties which may be cationic or noniomc.

The softening and/or conditioning compounds may be water insoluble quaternary ammonium compounds. The compounds may be present in amounts of up to 8% by weight (based on the total amount of the composition) in which case the compositions are considered dilute, or at levels from 8% to about 50% by weight, in which case the compositions are considered concentrates.

The hydrocarbon may be present in the fabric care composition in an amount of up to 5% by weight, such as up to 2% by weight, preferably 0.0001 to 1% by weight.

Compositions suitable for delivery during the rinse cycle may also be delivered to the fabric in the tumble dryer if used in a suitable form. Thus, another product form is a composition (for example, a paste) suitable for coating onto, and delivery from, a substrate eg a flexible sheet or sponge or a suitable dispenser (such as a container having apertures therein, for example) during a tumble dryer cycle.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric softening compound are predominantly linear.

Quaternary ammonium compounds having two long-chain aliphatic groups, for example distearyldimethyl ammonium chloride and di (hardened tallow alkyl) dimethyl ammonium chloride, are widely used in commercially available rinse conditioner compositions. Other examples of these cationic compounds are to be found in "Surface-Active Agents and Detergents", Volumes I and II, by Schwartz, Perry and Berch. Any of the conventional types of such compounds may be used in the compositions of the present invention.

The fabric softening compounds are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in "Handbook of Lipid Bilayers", D Marsh, CRC Press, Boca Raton, Fla., 1990 (pages 137 and 337). Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably less than $1\times10^{-8}$ to $1\times10^{-6}$ wt %.

Especially preferred are cationic fabric softening compounds that are water-insoluble quaternary ammonium materials having two $C_{12-22}$ alkyl or alkenyl groups connected to the molecule via at least one ester link, preferably two ester links. An especially preferred ester-linked quaternary ammonium material can be represented by the formula II:

(II)

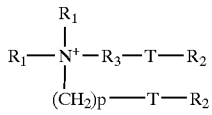

wherein each $R_1$ group is independently selected from $C_{1-4}$ alkyl or hydroxyalkyl groups or $C_{2-4}$ alkenyl groups; each $R_2$ group is independently selected from $C_{8-28}$ alkyl or alkenyl groups; and wherein $—R_3—$ is a linear or branched alkylene group of 1 to 5 carbon atoms, T is

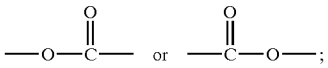

and p is 0 or is an integer from 1 to 5.

Di (tallowoyloxyethyl) dimethyl ammonium chloride and/or its hardened tallow analogue is especially preferred of the compounds of formula (II).

A second preferred type of quaternary ammonium material can be represented by the formula (III):

(III)

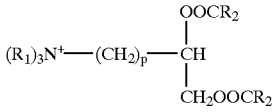

wherein $R_1$, p and $R_2$ are as defined above.

It is advantageous if the quaternary ammonium material is biologically biodegradable.

Preferred materials of this class such as 1,2-bis (hardened tallowoyloxy)-3-trimethylammonium propane chloride (HEQ) and their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic fabric softeners, as described in GB 2 039 556B (Unilever).

The compositions may comprise a cationic fabric softening compound and an oil, for example as disclosed in EP-A-0829531.

The compositions may alternatively or additionally contain nonionic fabric softening agents such as lanolin and derivatives thereof.

Lecithins are also suitable softening compounds.

Nonionic softeners include Lβ phase forming sugar esters (as described in M Hato et al Langmuir 12, 1659, 1966, (1996)) and related materials such as glycerol monostearate or sorbitan esters. Often these materials are used in conjunction with cationic materials to assist deposition (see, for example, GB 2 202 244). Silicones are used in a similar way as a co-softener with a cationic softener in rinse treatments (see, for example, GB 1 549 180).

Other suitable softeners include liquid or soft solid sugar esters of the type described in WO 98/16538, for example.

The compositions may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof. Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

The fabric conditioning compositions may include silicones, such as predominantly linear polydialkylsiloxanes, eg polydimethylsiloxanes or amino-silicones containing amine-functionalised side chains; soil release polymers such as block copolymers of polyethylene oxide and terephthalate; amphoteric surfactants; smectite type inorganic clays; zwitterionic quaternary ammonium compounds; and nonionic surfactants. Preferably, the silicone component is a dimethylpolysiloxane with aminoalkyl groups.

The fabric conditioning compositions may also include an agent which produces a pearlescent appearance, eg an organic pearlising compound such as ethylene glycol distearate, or inorganic pearlising pigments such as microfine mica or titanium dioxide ($TiO_2$) coated mica.

The fabric conditioning compositions may be in the form of emulsions or emulsion precursors thereof.

Other optional ingredients include emulsifiers, electrolytes (for example, sodium chloride or calcium chloride) preferably in the range from 0.01 to 5% by weight, pH buffering agents, and perfumes (preferably from 0.1 to 5% by weight).

Further optional ingredients include non-aqueous solvents, perfume carriers, fluorescers, colourants, hydrotropes, antifoaming agents, antiredeposition agents, enzymes, optical brightening agents, opacifiers, anti-shrinking agents, anti-wrinkle agents, anti-spotting agents, dye transfer inhibitors, germicides, fungicides, anti-oxidants, UV absorbers (sunscreens), heavy metal sequestrants, chlorine scavengers, dye fixatives, anti-corrosion agents, drape imparting agents, antistatic agents and ironing aids. This list is not intended to be exhaustive.

The method of the invention for producing the fabric care composition comprises forming an emulsion comprising the hydrocarbon and the textile compatible carrier. The method may comprise the formation of a pre-emulsion with an emulsifying agent (preferably a nonionic emulsifying agent) followed by the addition of water to the pre-emulsion, with stirring. Preferably, when the textile compatible carrier is a solid at room temperature, the method comprises the step of mixing the hydrocarbon and the textile compatible carrier at a temperature above the melting point of the textile compatible carrier and then forming an emulsion by stirring the mixture with an aqueous phase (such as water) at a temperature above room temperature. This latter method is particularly useful for the production of fabric care compositions when the textile compatible carrier is a quaternary ammonium compound.

Preferably, the garment care product of the invention is adapted for use in a tumble dryer and comprises a substrate which acts as a carrier for the hydrocarbon. The term "substrate" covers any means for delivering the hydrocarbon to the fabric in the tumble dryer, such as a vehicle or carrier. Thus, substrates include, for example, containers into which the hydrocarbon, or a composition containing the hydrocarbon, is added having one or more apertures to allow the hydrocarbon to pass out of the container and into contact with the fabric. Preferably, however, the substrate is a flexible sheet, such as of fabric or paper. The sheet needs to have some affinity for the hydrocarbon so that it can act as a carrier or support for the hydrocarbon in order that it can transfer the hydrocarbon with the sheet into the tumble dryer. However, the sheet must not have such a strong affinity for the hydrocarbon that none or only a small amount of the hydrocarbon is transferred to the fabric.

The treatment of fabrics with a hydrocarbon or a composition comprising a hydrocarbon, according to the invention, has been found to improve the crease recovery properties of a fabric. The crease recovery properties can be measured by determining the degree to which a fabric returns to its original state after the removal of a force which induces a crease in the fabric and methods for carrying out such measurements are well-known in the art. Suitable tests include the use of a Shirley Development Crease Recovery Angle Tester according to ISO 2313, BS 22313 or AATCC 66 Standards.

The method of the invention is useful when a fabric is dried in a tumble dryer. Treatment of the fabric prior to tumble drying can reduce the tendency of the fabric to become creased.

Fabric treated with a hydrocarbon, according to the invention, has the unexpected advantage of increased wettability. It is surprising that the treatment of fabric with a hydrophobic compound has the effect of increasing wettability. The increased wettability can make the fabric easier to press with a steam iron by increasing the rate of absorption of water from the steam iron into the fabric. Fabric treated according to the invention can also have a softer handle relative to fabric not so treated and there may also be skin benefits (such as a reduced incidence of dermatitis for some people) when the fabric is worn.

The fabric of the invention may be in the form of a garment. Desirably, the fabric comprises cellulosic fibres and preferably the cellulosic fibres are of cotton. The fabric suitably contains from 50 to 100% cotton, such as 75 to 100% cotton. When the fabric is not 100% cotton, the other fibres in the fabric may be of polyester, polyamide or other fibres which are conventionally used together with cotton in a fabric or mixtures of such fibres.

The hydrocarbon may be applied to the fabric as a spray either before or during drying in a tumble dryer. Suitable dispensers for the spray include aerosol delivery devices, other pressurised containers and other containers in which the spray is generated by pressurising the container manually, as is well-known in the art. Spray dispensers and methods of formulation which may be used, for example, are disclosed in WO 96/15310.

The following non-limiting examples illustrate the present invention.

The following figures are referred to in the examples:

EXAMPLE 1

Figure 1:
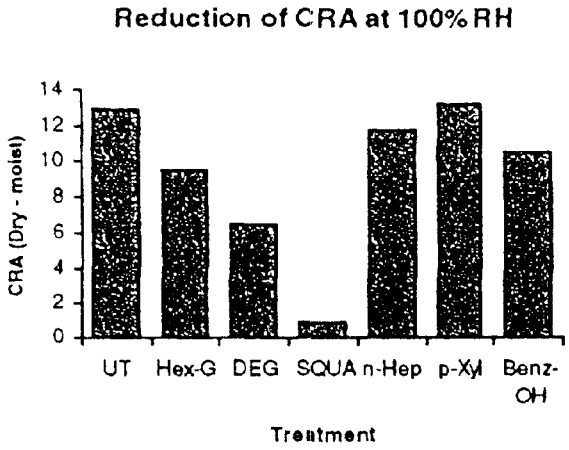
FIG. 1 is a graph showing the crease recovery angle (CRA) for fabric treated according to the invention relative to other fabrics.

Cotton sheeting (100% cotton), 150 cm square and about 100 g/m$^2$ was pre-washed in Persil® at 50° C. and fully rinsed. 10 replicate samples were used for each test, size 2.5 cm×5.0 cm. The samples were cut from the centre region of the fabric roll and warp and face were marked. Samples were creased in the warp bending direction and folded consistently from the face side. The effect of fabric pre-treatment such as solvent washing, ironing, drying regime and the effect of deviation from the warp direction were evaluated. Before treatment all the samples were randomised to reduce the well-known positional effects across the manufactured fabric roll.

Oil finishes were applied from n-heptane and the water solubles from the deionised water. A solvent-only sample was included for reference. The level of application of treatment was 1% on weight of fabric. The oil was applied as a solution such that 50 $\mu$l could be spotted over each sample using a micropipette. The 20 treated samples were divided randomly into two sets of 10 to be conditioned at room conditions or a 100% relative humidity (RH) chamber. The solvent was fully dried off before conditioning.

The CRA was measured using a modified test where the maximum loading was 500 g and the time was 30 seconds in compression and 30 seconds opening before the angle was recorded. The characteristic rate of opening with time suggested that 30 seconds was optimum. After this time the rate of increase in angle is very small. The Shirley Development Crease Recovery Angle Tester was used for this study. This meets ISO 2313, BS 22313, AATCC 66 standards. But the conditions were altered to meet the requirements of this study.

Polar and non polar materials were used and as can be seen from the results given in FIG. 1, the squalane seemed to reduce the dip in CRA at high regain. This result shows that squalane can affect the ability of fabric to recover after creasing. In this particular experiment the fabric had not reached full equilibrium in the 100% RH atmosphere but the Cpp characteristic and the effect of various materials is clearly visible. In FIG. 1, CRA (Dry-moist) is shown for an untreated (UT) sample and for samples treated with hexylene glycol (hex-G), diethylene glycol (DEG), squalane (SQUA), n-heptane (n-Hep), para-xylene (p-Xyl) and benzyl alcohol (Benz-OH).

Figure 2:
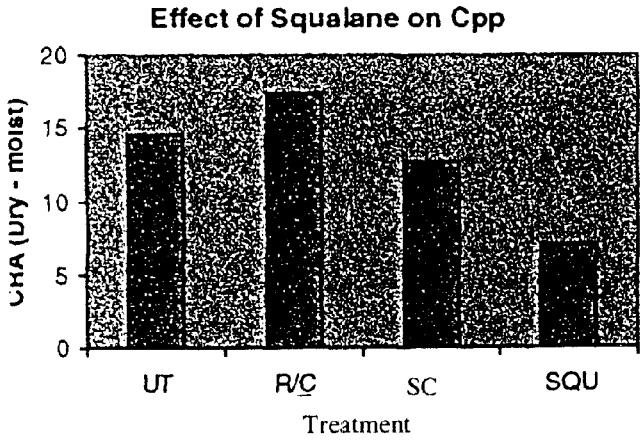
FIG. 2 is a repeat of similar graph (see Example 1) to FIG. 1 but with tests carried out on a different fabric.

Squalane was included in another set of screening materials and again showed some advantages over other treatments with rinse conditioner (RC) (Comfort® fabric conditioner, Unilever, UK) and monosaccharide (SC) (see FIG. 2).

EXAMPLE 2

Figure 3:
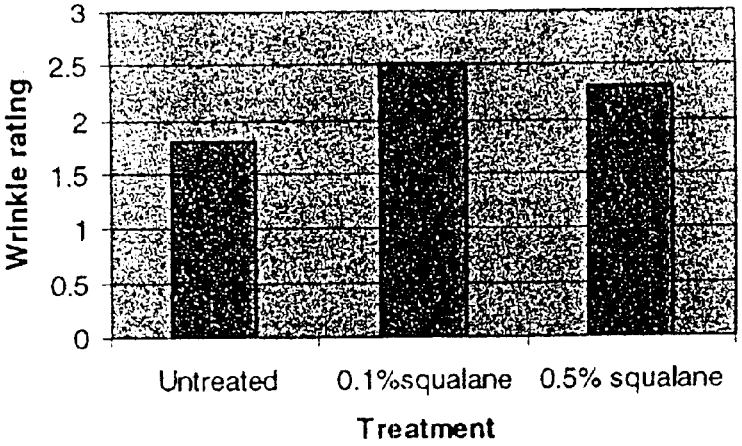
FIG. 3 shows the relative creasing, after tumble drying, of fabric untreated and treated with squalane at different levels.

Samples of sheeting measuring 20 cm×20 cm were treated with squalane at 0.1 and 0.5% from n-heptane and allowed to dry fully. They were then conditioned to 80% moisture by spraying. This simulates the out-of-spin dryer condition where 80% moisture is typical for this material. The samples, five replicates, were then "injected" into a tumble dryer with a 2 kg wet load and run for 60 minutes. The results are shown in FIG. 3.

In this test, the fabrics were rated against the Wrinkle rating scale where "1" is heavily creased and "3" is slightly creased. The results therefore represent a worthwhile benefit under the specific conditions of the test.

EXAMPLE 3

Formation of a Fabric Conditioning Composition

Squalane (Aldrich) was added to HEQ as a "Hot melt". The HLB (approximately 17) of the HEQ is a little high for the oil but the large excess 1:4 of squalane to HEQ ensured good emulsification. The melt was clear and stable. The melting conditions were:

Melt HEQ+Squalane (4:1 weight ratio) at 80° C.
Add 50% water to the mix at 80° C.
Add bulk of water cold.

This gives a stable dispension containing 5% by weight total actives (ie, HEQ plus squalane), which exhausts onto fabric.

Fabric (Tencel (trade mark)) treated with the composition in the rinse cycle of a conventional front loading automatic washing machine was assessed for creasing against AATCC TM128 standards after tumble drying. Comparisons were carried out against untreated fabric (ie, no rinse application), and fabric treated with Comfort (trade mark) fabric conditioner (Unilever, UK) alone and with Comfort (trade mark) containing 1% paraffin (SIRIUS M125 (trade mark)). The results are as follows:

| Finish | Wrinkle rating |
|---|---|
| Untreated | 2.2 |
| Comfort | 1.6 |
| Composition of the invention | 2.6 |
| Comfort + Paraffin | 2.4 |

*Comfort is a trade mark

EXAMPLE 4

Wetting of Fabric

Fabric (Cotton Sheeting 150 gm$^{-2}$) was washed using Persil (trade mark) detergent at 50° C. 5% of each treatment was applied by padding (100% of pick up of 5% solution). The treated samples were passed through pad rollers at 80 Kb pressure, setting 2 meters/min. The samples were line dried (flat), then sprayed back to 80% moisture and left to soak for 60 mm. Then the samples were tumble dried (Miele (trade mark) normal setting) with ¼ load (about 500 g) ballast. Test pieces were 20 cm×20 cm square. The samples were removed and rated against AATCC TM 128 wrinkle standards. It was noted that the fabric treated with Squalane wetted rapidly from the spray, whereas the fabric treated with Comfort (trade mark) conditioner only was slow to penetrate.

EXAMPLE 5

Further evaluation of Squalane based formulation in tumble drying

1. Larger squares (30 $cm^2$) of cotton sheeting were treated by pad—for quantitative delivery.
2. Each treatment was dried separately for better resolution of differences.
3. These were run without a ballast, to maintain finish concentration.
4. Wrinkle ratings were done by panel assessment to reduce bias.
5. Fabrics were tested for absorbency after drying.

Test pieces of cotton sheeting (30 cm×30 cm) were treated by padding with 5% of rinse conditioner based on the weight of fabric. As all samples were 5% active this produces 0.25% solids application. The pad was therefore adjusted to give 100% pick up. Samples were then stored overnight in sealed bags. The samples were dried in a Miele (trade mark) tumble dryer for a full drying cycle. After drying, the samples were assessed against the TH128 test standards for Wrinkle rating, 1 to 5 where 5 is uncreased. The results are shown below.

| | Panellist 1 | Panellist 2 | Panellist 3 | Panellist 4 | Panellist 5 |
|---|---|---|---|---|---|
| ut | 1.36 | 1.7 | 1.99 | 1.93 | 1.84 |
| c | 1.69 | 1.91 | 1.86 | 1.82 | 1.67 |
| fs | 1.89 | 1.96 | 2.47 | 2.07 | 2.09 |
| fp | 1.66 | 1.87 | 2.39 | 2.14 | 1.93 |

The results are the mean wrinkle ratings of 7 replicates from 5 panelists. Samples were "ut" is untreated, "c" is standard rinse conditioner (Comfort (trade mark)), "fs" is squalane formulation according to Example 3 and "fp" is a paraffinic formulation (as described in Example 3).

This result shows that the squalane formulation gives a higher wrinkle rating than the paraffinic formulation and that both are better than a standard rinse conditioner.

EXAMPLE 6

Evaluation of squalane formulations on garments in domestic laundry conditions

Ten 65/35 Polyester/Cotton shirts (Savantini Easy care ex Matalan) were washed in Persil (trade mark) at 40° C. The test formulations set out below were added to the rinse in place of the normal rinse conditioner. The shirts were tumble dried in the normal cycle of a Miele (trade mark) tumble dryer. The shirts were dried in pairs to prevent cross contamination. At the end of the drying cycle the shirts were placed on hangers and the creasing compared in a paired comparison test.

| Test formulation: | |
|---|---|
| 1. | Untreated |
| 2. | Comfort (trade mark), 5% by weight actives |
| 3. | Squalane formulation * |
| 4. | Paraffinic formulation * |

* Prepared according to Example 3, 5% by weight total actives.

The method of paired comparisons was carried out as described in "W Mooney, Textile softeners today: a special in-depth review, Textile Month, October 1980, pages 32 to 71". The criteria for judgement in each comparison was overall creasing. The samples were presented in random order. This test results in two comparisons for each sample so that four comparisons were made for each treatment. The following overall results were recorded.

| Treatment (Test Formulation No.) | Preference | Wetting time** |
|---|---|---|
| 1 | 4 | 30 |
| 2 | 7 | 110 |
| 3 | 7.5 | 90 |
| 4 | 6.5 | 100 |

**The mean time in seconds for a single drop of water of standard size to penetrate fully the surface of the fabric.

The squalane formulation was overall less creased on removal from the tumble dryer. This advantage is worthwhile as the wrinkle formation in the tumble dryer is normally difficult to control. Polyester/cotton shirts tend to emerge from tumble drying with wrinkle ratings of 4 or better, so the function of a lower wrinkling formulation is to reduce the number of occasions where ironing is required. Again the wetting time was improved over a standard cationic-only formulation.

What is claimed is:

1. A method of treating a fabric in order to improve its crease recovery properties comprising the step of applying to the fabric a hydrocarbon selected from squalane, a $C_1$–$C_3$ alkyl mono- or poly-substituted derivative of squalane, a homologue of squalane or mixtures thereof; wherein the hydrocarbon is applied to the fabric simultaneously with a fabric softening product and wherein the fabric treatment method is associated with a laundering, tumble drying, or ironing process.

2. A method as claimed in claim 1, wherein the fabric comprises cotton.

3. A method as claimed in claim 1, wherein the hydrocarbon is applied to the fabric before or during drying in a tumble dryer.

4. A method as claimed in claim 3, wherein the hydrocarbon is applied to the fabric as a spray.

5. A method as claimed in claim 3, wherein the hydrocarbon is applied to the fabric during drying in a tumble dryer in the form of a garment care product.

6. A method as claimed in claim 5 wherein the garment care product comprises a substrate which acts as a carrier for the hydrocarbon.

7. A method as claimed in claim 6, wherein the substrate is a flexible sheet.

8. A method as claimed in claim 6, wherein the flexible sheet is of fabric or of paper.

9. A method as claimed in claim 6, wherein the garment care product also comprises a textile compatible carrier, which facilitates contact between the hydrocarbon and the fabric and wherein the composition is applied to the fabric as a spray.

10. A method as claimed in claim 9, wherein the fabric softening agent is a quaternary ammonium compound.

11. A method as claimed in claim 9, wherein the hydrocarbon is applied in the rinse cycle of a laundering process.

12. A method as claimed in claim 6, wherein the hydrocarbon is squalane.

13. A method as claimed in claim 6, wherein the garment care product further comprises a perfume.

14. A method as claimed in claim 1, wherein the hydrocarbon is applied to the fabric during the rinse cycle of a laundering process.

* * * * *